United States Patent [19]

Gunjian

[11] 4,056,863

[45] Nov. 8, 1977

[54] GRILL CLEANING BRUSH

[76] Inventor: Armen G. Gunjian, 11270 Boulevard l'Acadie, Montreal, Quebec, Canada

[21] Appl. No.: 710,667

[22] Filed: Aug. 2, 1976

[51] Int. Cl.[2] ..... A46B 3/18

[52] U.S. Cl. ..... 15/160; 15/206; D4/8

[58] Field of Search ..... 15/159, 160, 154, 164, 15/165, 209 D, 210 A, 206, 104.04; 427/11, 433; 99/419; D4/8, 9, 10–12

[56] References Cited

U.S. PATENT DOCUMENTS

| | | | |
|---|---|---|---|
| 1,053,664 | 2/1913 | Sommer | 427/433 X |
| 1,762,182 | 6/1930 | Mayer | 15/209 D |
| 2,813,291 | 11/1957 | Wark | 15/209 D |
| 3,230,563 | 1/1966 | Swanson | 15/164 |

FOREIGN PATENT DOCUMENTS

| | | | |
|---|---|---|---|
| 2,114,375 | 10/1922 | Germany | 427/11 |
| 1,211,579 | 3/1966 | Germany | 15/165 |
| 18,344 of | 1895 | United Kingdom | 15/165 |
| 24,259 of | 1898 | United Kingdom | 15/206 |

*Primary Examiner*—Peter Feldman

*Attorney, Agent, or Firm*—Diller, Brown, Ramik & Wight

[57] ABSTRACT

An improved grill cleaning brush in which the cleaning of the grill ribs is effected by portions of the bristles intermediate the ends thereof, rather than the ends of the bristles. As a result, a more efficient cleaning of the grill ribs is effected. Further, the improved grill brush permits the application of additional pressure to the brush by providing a V-shaped construction of intermeshing brushes, with the bristles at the lower end of the brushes engaging the shank portion of the adjacent brush element.

2 Claims, 6 Drawing Figures

GRILL CLEANING BRUSH

BACKGROUND OF THE INVENTION

1. Field of the Invention

This invention relates to an improved grill cleaning brush.

2. Description of the Prior Art

A number of brush constructions for different purposes are disclosed in the prior art, some of which can be utilized for cleaning the elongated ribs of a grill. For example, U.S. Pat. No. 3,760,449, issued September 25th, 1973 to Swanson, discloses a brush structure having parallel brush elements which can be utilized for cleaning a grill structure. Adjacent end portions of the bristles of the brush elements intermesh over the length of the individual brushes. The drawback with this type of arrangement is that cleaning of the ribs of a grill is effected by only the ends of the individual bristles due to the minimum amount of overlapping of the bristles of adjacent brushes. Further, due to the parallel arrangement of the brushes, only a minimum amount of pressure can be applied to the ribs of the grill with the brush, otherwise the rib will pass along the length of the parallel-mounted brushes. In other words, the limited overlapping of the bristles does not provide any resistance to a rib passing along the length of the bristles between adjacent brushes and ending up at a location between the shank portions of the brushes. Such a situation can easily arise when one applies pressure to the brush in order to remove hardbaked grease or goo from the grill ribs, as is frequently necessary in many cases.

SUMMARY OF THE INVENTION

The present invention provides an improved grill cleanng brush in which the cleaning of the grill ribs is effected by portions of the bristles intermediate the ends thereof, rather than the ends of the bristles. As a result, a more efficient cleaning of the grill ribs is effected. Further, the improved grill cleaning brush permits the application of additional pressure to the brush by providing a V-shaped construction of intermeshing brushes, with the bristles at the lower end of the brushes engaging the shank portion of the adjacent brush element.

As a further feature of the present invention, the shank portions of the improved grill cleaning brush do not require bending in order to situate the brushes in parallel arrangement, as disclosed in the prior art brush arrangements. As a result, the step of bending the shank portions of the brushes is eliminated with the present construction, thereby providing a brush which is less expensive to manufacture by eliminating a step in the construction thereof.

According to the present invention, there is provided an improved grill cleaning brush having a pair of elongated cleaning elements mounted on respective shank portions, ends of these shank portions opposite from the cleaning elements being mounted in a handle. The shank portions supporting the cleaning elements diverge away from the handle so as to define an open jaw adapted to receive a grill rib between the cleaning elements. Intermeshing of the cleaning elements increases along the length thereof and is greatest at a location closest to the handle.

In a preferred embodiment of the present invention, the cleaning elements comprise wire bristles extending outwardly from the shank portions, the wire bristles intermeshing over their length. The bristles adjacent the end of the cleaning elements closest to the handle overlap to such an extent as to engage the shank portion of the adjacent cleaning element.

BRIEF DESCRIPTION OF THE DRAWINGS

In a drawing which illustrates the embodiments of the present invention.

DESCRIPTION OF THE PREFERRED EMBODIMENTS

Figure 1:
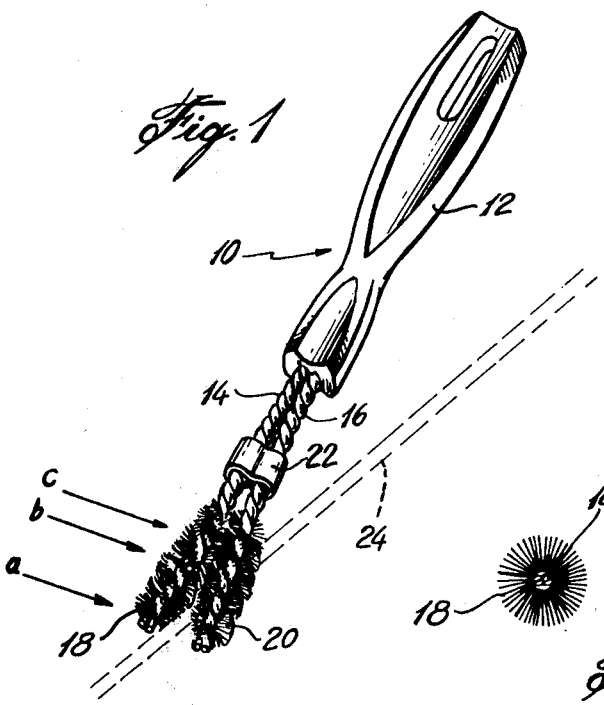
FIG. 1 is a plan view of one embodiment of the grill cleaning brush according to the present invention when in use.
Figure 2:
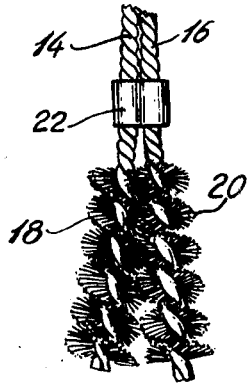
FIG. 2 is a plan view of the brush elements of the grill cleaning brush illustrated in FIG. 1 when not in use.
Figure 3:
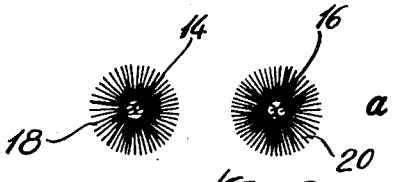
FIG. 3 is a plan view taken along the line indicated by *a* of FIG. 1.
Figure 4:
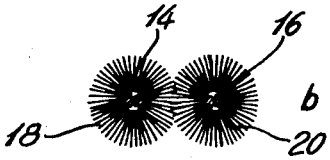
FIG. 4 is a plan view taken along the line indicated by *b* of FIG. 1.

In the drawings, the improved grill cleaning brush is indicated generally by reference numeral 10. The grill brush has a handle 12 supporting the ends of a pair of shank portions 14 and 16, the shank portions having respective elongated cleaning elements or brushes 18 and 20 mounted thereon. As best seen in FIG. 1, the shank portions 14 and 16 diverge outwardly at their ends opposite from the handle 12 so as to form the V-shaped portion adjacent the ends of the brush elements.

Figure 5:
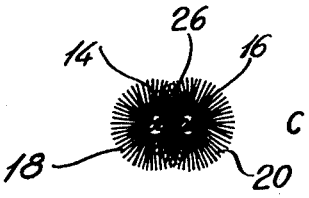
FIG. 5 is a plan view taken along the line indicated by *c* of FIG. 1.

A metal clip 22 encircles the shank portions 14 and 16 at a location between the cleaning elements or brushes 18 and 20 and the handle 12. The metal clip 22 forces the interengagement of the bristles adjacent the lower ends of the cleaning elements 18 and 20, as seen in FIG. 5, with the interengagement of the bristles closer to the ends of the shank portions defining the V-shaped receiving portion of the cleaning elements. The V-shaped configuration permits the insertion of a grill rib 24 between the cleaning elements, as seen in FIG. 1.

As noted above, in prior art brushes used for cleaning grill ribs, the cleaning is effected by the rubbing action of the ends or the tips of the bristles forming the cleaning elements or brushes. As seen in FIG. 5, the intermeshing bristles forming the cleaning elements define a bridge 26 at a location part way along the length of the cleaning elements 18 and 20, the bridge 26 effecting the cleaning of the grill rib 24. Thus, the cleaning of the rib 24 is effected by portions of the bristles intermediate the lengths thereof, as opposed to the tips of the bristles. Interengagement of the bristles adjacent the lower end of the cleaning elements is such that considerably greater pressure can be applied to the brush when cleaning the grill ribs without the grill rib passing between the cleaning elements. As a result, the grill brush 10 can effect more efficient cleaning of baked grease and goo from the ribs of a grill.

The cleaning elements or brushes 18 and 20 are formed from high tensile wire bristles which, together with the shank portions 14 and 16, are coated with zinc in order to prevent the formation of rust. The shank portions 14 and 16 are formed from twisted wire with the bristles mounted on the twisted wire adjacent the end thereof in a known manner. Likewise, the mounting of the twisted wire shank portions in the handle is effected in a known manner, the handle being preferably made of plastic.

Cleaning of a grill utilizing the improved grill brush simply involves the long rib of the grill being inserted in the V-shaped portion of the cleaning elements as seen in FIG. 1, and pushing the grill brush along the length of the long ribs 24 of the grill. The short cross-ribs of the grill are cleaned with the outer bristles of the cleaning element or brushes 18 or 20.

Since the V-shaped portion between the cleaning elements is formed by the interengagement of the bristles of the cleaning elements or brushes, with the metal clip forcing the lower bristles of the cleaning brushes into tight interengagement, it is unnecessary to bend the shank portions 14 and 16 to any desired position. As a result, a step normally necessary with known brush configurations is eliminated with the present invention. Assembly of the brush involves the insertion of the twisted wire shank portions 14 and 16 into the end of a handle 12 and the application of a metal clip 22 at a location spaced between the cleaning elements and the end of the handle.

The construction of the metal brush can be modified in order to utilize a longer handle, the end of which would terminate adjacent the cleaning elements, thereby eliminating the necessity of providing a separate metal clip. Alternatively, the metal clip 22 can be slidable along the shank portions 14 and 16 between the handle and the cleaning elements in order to widen or narrow the V-shaped groove formed by the cleaning elements so as to form new bridges 26 at unworn parts of the cleaning elements.

Figure 6:
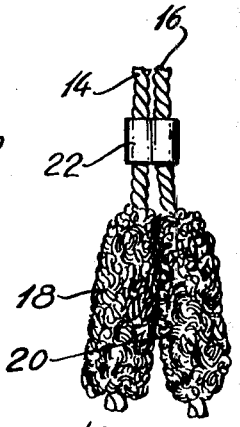
FIG. 6 is a top plan view of a further embodiment of the brush elements according to the present invention.

As seen in FIG. 6, the cleaning elements 18 and 20 can comprise interwoven metal or metallic wool, rather than metal bristles. Intermeshing of lower portions of the inverwoven metal or metallic wool cleaning elements 18 and 20 effectively provides a bridge 26 for cleaning the ribs 24 of a grill.

I claim:

1. An improved grill cleaning brush comprising a handle, a pair of straight shanks extending from said handle in substantially parallel contiguous relation, and a cleaning element carried by each shank remote from said handle, each cleaning element being in the form of high tensile wire bristles radiating from the respective shank along an end portion thereof, said bristles being densely arranged and resisting intermeshing of said cleaning elements wherein said shanks would normally diverge from said handle, and a clip encircling said shanks adjacent said cleaning elements and spaced from said handle, said clip maintaining said shanks in said parallel relation between said handle and said clip, said clip further forcing said bristles of the two cleaning elements into meshing engagement with the resistance of said bristles to such meshing engaging effecting a diverging of said shanks beyond said clip and said cleaning elements automatically assuming a V relationship defining a V-shaped end portion on said brush for receiving a grill rib therebetween, said wire bristles being tightly engaged in overlapping relation adjacent said clip and constantly defining a positive cleaning bridge for preventing a grill rib to pass between said cleaning elements to said clip even when a high cleaning pressure is applied.

2. An improved brush according to claim 1, wherein the shank portions comprise twisted wire coated with zinc to prevent rusting and the high tensile wire bristles are coated with zinc to prevent rusting.

* * * * *